US008052079B2

(12) United States Patent
Celoudoux et al.

(10) Patent No.: US 8,052,079 B2
(45) Date of Patent: Nov. 8, 2011

(54) COILER AND METHOD FOR MANUFACTURING A COIL

(75) Inventors: Jean Paul Celoudoux, Aix-en-Provence (FR); Bruno Daugy, St. Maxime (FR); Louis Soriano, Aubagne (FR); Beat Estermann, Dierikon (CH)

(73) Assignee: Komax Holding AG, Dierikon (CH)

( * ) Notice: Subject to any disclaimer, the term of this patent is extended or adjusted under 35 U.S.C. 154(b) by 479 days.

(21) Appl. No.: 12/114,136

(22) Filed: May 2, 2008

(65) Prior Publication Data

US 2009/0039194 A1 Feb. 12, 2009

(30) Foreign Application Priority Data

May 4, 2007 (EP) ..... 07107578

(51) Int. Cl.
*B21C 47/02* (2006.01)
*B65H 54/56* (2006.01)

(52) U.S. Cl. ..... 242/362; 242/472.5

(58) Field of Classification Search ..... 242/472.5, 242/363, 362.3, 362.2, 362.1, 362, 360, 361.5, 242/361.3, 361.4
See application file for complete search history.

(56) References Cited

U.S. PATENT DOCUMENTS

| | | | | |
|---|---|---|---|---|
| 353,047 | A * | 11/1886 | Young | 242/361.5 |
| 2,624,771 | A | 1/1953 | Hanson | |
| 4,390,137 | A | 6/1983 | Hammond, Jr. et al. | |
| 5,427,327 | A | 6/1995 | Anderson et al. | |
| 5,570,853 | A | 11/1996 | Teng | |
| 6,948,675 | B2 * | 9/2005 | Frommenwiler | 242/362.2 |

FOREIGN PATENT DOCUMENTS

| | | | |
|---|---|---|---|
| DE | 30 47 887 | A1 | 7/1982 |
| DE | 42 35 007 | A1 | 4/1994 |
| EP | 1 387 449 | A1 | 2/2004 |
| EP | 1 452 474 | A1 | 9/2004 |
| JP | 57-131678 | A | 8/1982 |
| JP | 58-112912 | A | 7/1983 |
| WO | 03/018456 | A1 | 3/2003 |

* cited by examiner

*Primary Examiner* — William E Dondero

(74) *Attorney, Agent, or Firm* — Fraser Clemens Martin & Miller LLC; William J. Clemens

(57) ABSTRACT

A swivel machine for wire processing includes a coiler arranged between a cutting-off/insulation-stripping unit and a second swivel arm. The cut length of wire whose leading wire-end has been processed is coiled by means of a coiling disk of the coiler. After the leading wire-end of the cut length of wire has been processed, it is grasped by the coiler. A belt drive then advances the wire by the desired length of the cut length of wire, and simultaneously the coiler coils the advancing wire into a coil. After the coiling operation, a linearly movable stacker unit grasps the coil, and the coiling disk releases the coil. After the trailing wire-end has been processed, the placement unit moves further in the wire advance direction to the deposit. While the trailing wire-end is being processed, and while traveling to the deposit, the coil is provided with a bind.

12 Claims, 14 Drawing Sheets

COILER AND METHOD FOR MANUFACTURING A COIL

FIELD OF THE INVENTION

The present invention relates to a coiler and a method for manufacturing a coil with at least one winding, wherein a coiler gripper that is arranged on a rotatable coiling disk firmly holds the leading wire-end of a cut length of wire, and fingers that are arranged peripherally on the coiling disk form the cut length of wire into the coil.

BACKGROUND OF THE INVENTION

The patent application DE 42 35 007 A1 discloses a coiling device for cut lengths of wire wherein the inside walls of a drum serve as resting surfaces for formation of the coil and thereby define the external diameter of the coil. In this device, while the wire is being inserted, the drum remains stationary and is opened when the wire length has been attained and the coil bound. Following transfer of both wire-ends of the coil to transfer grippers, subsequent wire-end processing operations as, for example, crimp pressing and/or seal loading, can be performed. Besides advantages from low moving masses, there are also disadvantages as, for example, uncontrollable bending radii when inserting and compressing the various coil layers for binding. Whether the individual windings always lie against the wall is uncertain. Minimum bending radii on entry and emergence of the wire into, and out of, the drum are also not defined.

From patent specification EP 1 387 449 B1 a coiling device with controllable minimum bending radius for wires, especially optical-fiber wires, has become known. In this device, the cut length of wire is coiled by means of a coiling unit into a coil, and after attaining the correct wire-length the wire-ends are of identical length and after the coil has been bound, the wire-ends are accepted by transfer grippers for further processing. For optical-fiber wires the high outlay for mechanics and controls is more readily justified than for wires with copper conductors.

Patent application WO 03/018456 A1 discloses a coiling device for a coil with a rotating coiling arbor, on which hanging and open able coiling arms are arranged. Depending on the cut length of wire, the arms are opened more or less, so that when the wire length is attained, the two wire-ends are approximately the same length. For processing of the wire-ends, after the coil has been bound it is accepted by transfer grippers.

On many types of wire processing machines, the handling of long cut lengths of wire (for example, greater than 7 meters wire length) is difficult. On swiveling machines with swivel arms, the wire tray must be as long as the cut length of wire. On transfer machines with a transfer unit that can be moved along straight lines, during transportation several loop-shaped wires lie on top of each other, which on rapid transportation by means of the transfer unit can cause relatively high wire-pulling forces because the wire is only held at its ends.

In the said patent applications, solution concepts for transfer machines are shown. Separate coiling devices downstream of the wire processing machine have not established themselves because, with the serial processing operations, the cycle time or total processing time for a coiled cut length of wire was correspondingly long.

SUMMARY OF THE INVENTION

It is here that the present invention sets out to provide a remedy. The present invention solves the problem of creating a device and a method for manufacturing long cut lengths of wire without lengthening the total processing time.

The device according to the present invention is particularly suitable for wire processing machines with swivel arms. The device according to the present invention can, however, also be used on transfer machines with linearly movable transportation units if additional grippers and receiving devices for handling the wire-ends of the wire coil are provided.

In the following exemplary embodiment of a wire processing machine with swivel arm, the coiler is arranged between a cutting-off/insulation-stripping unit and a second swivel arm. Coiling of the cut length of wire takes place by means of a coiling disk which, by means of a controlled motor, depending on an also motor-controlled belt drive, is rotatable, the belt drive serving to advance the wire and measure the length of the advanced wire. This arrangement is particularly advantageous for elastic wires. The leading wire-end of the wire that is to be coiled is processed by means of processing stations and, after processing, swiveled back to the cutting-off/insulation-stripping unit by means of a first swivel arm and advanced with the belt drive a short distance, so that the coiler can grip the leading wire-end. The belt drive then advances the wire by the desired length of the cut length of wire, and the coiler coils the advanced wire simultaneously into a coil. After the coiling operation, a linearly movable stacker unit grips the coil. When doing so, the coiling disk pneumatically de-tensions its tension finger and travels pneumatically backwards. Profiled plates acting as remover prevent the coil from being pulled backwards. The stacker unit then moves back with the coil so that the trailing wire-end can be cut off and stripped of insulation and if necessary processed, a second swivel arm feeding the trailing wire-end to processing stations. Grippers of the stacker unit hold the coil, and the deposit unit moves until it is approximately under the swivel point of the second swivel arm and the trailing wire-end can, if necessary, for processing of its end still be pulled out of the coil by means of the second swivel arm. After the trailing wire-end has been processed, the stacker unit moves further in the wire-advancing direction to the deposit. While the trailing wire-end is being processed, and during the travel to the deposit, the coil can be provided with a bind. The coil can be provided with the bind during processing of the trailing wire-end, or during processing of the leading wire-end of the next cut length of wire. Thereafter, the bound coil can be placed into containers, onto transportation belts, or onto other receptors as, for example, arbors.

The advantages achieved by means of the present invention are mainly to be seen in that the binding operation on the coil proceeds simultaneously with the processing operation on the cut length of wire. The total processing time for the cut length of wire, also known as the machine cycle time, is thus not lengthened. The total processing tire remains the same with or without bind. The time for manufacturing the coil is comparable with the time for placing into the deposit a straightened cut length of wire on a conventional wire processing machine.

Mechanically, the coiler and stacker unit are not arranged as a separate device from the wire processing machine, but form an integral unit of the wire processing machine. The cut length of wire that is to be manufactured and processed is cut off to length from the wire stock, its leading wire-end processed, coiled, possibly its trailing wire-end processed, and as a coil with bind handed over to the deposit without any manual intervention being necessary.

Also advantageous is that the wire processing machine, despite long cut lengths of wire, is shorter dimensioned than a conventional wire processing machine. The length of the wire processing machine is not determined by the length of the cut length of wire.

In the wire processing machine according to the present invention, and in the method according to the present invention for manufacturing and processing a cut length of wire, the cut length of wire is cut off to length from a stock of wire and its wire-ends processed, a coiler being provided that forms the cut length of wire into a coil with at least one winding, and a stacker unit with a binding device providing the coil with a bind.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
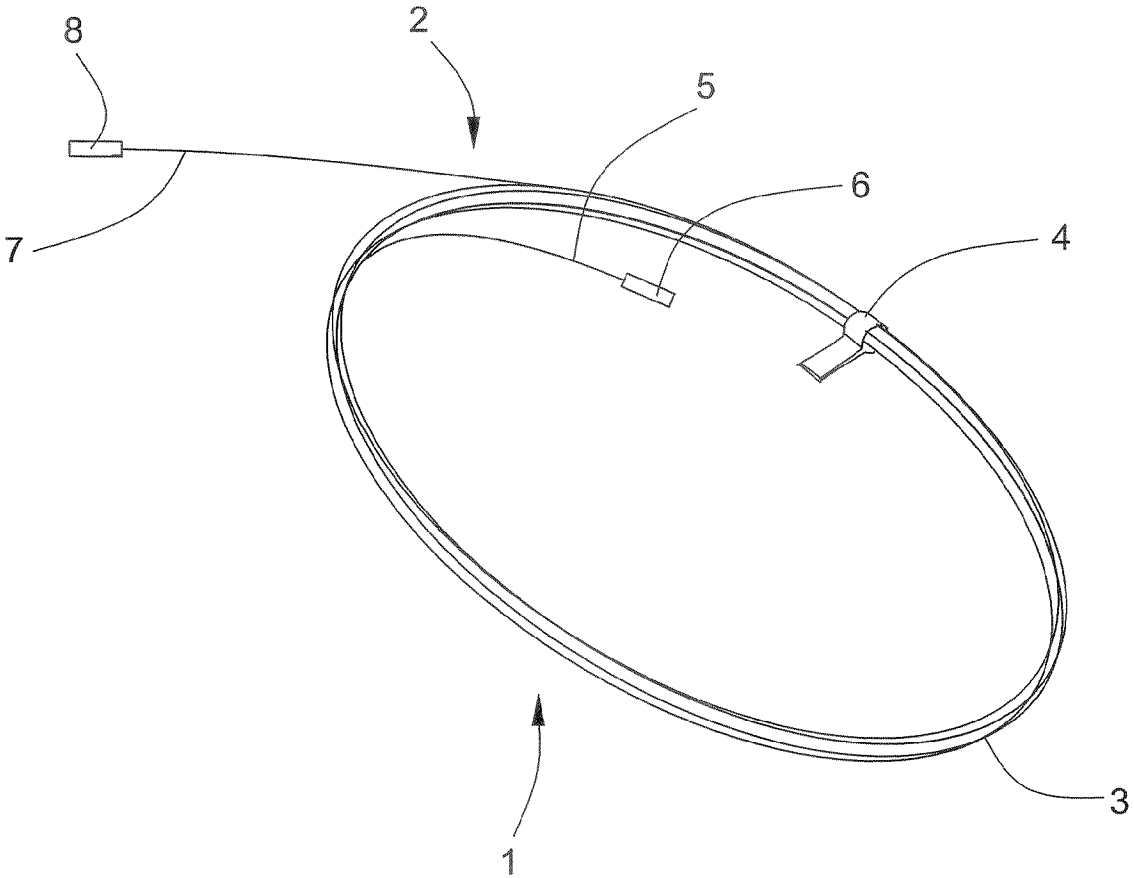
FIG. 1 is a perspective view of a cut length of wire that is formed into a coil.

FIG. 1 shows a cut length of wire 1 that with several turns 3 is formed into a coil 2, the turns 3 being held together by means of a bind 4. The bind 4 can take the form of, for example, a tape with adhesive applied to one side, the adhesive side of the tape embracing the turns 3, and the adhesive sides of the tape-ends resting against each other. The leading wire-end 5 has been processed, for example a crimp contact 6, possibly with a sealing seal, has been loaded. The leading wire-end 5 may also be only stripped of insulation or not processed at all. The trailing wire-end 7 has been processed, for example a crimp contact 8, possibly with a sealing seal, has been mounted. The trailing wire-end 7 may also be only stripped of insulation or not processed at all.

Figure 2:
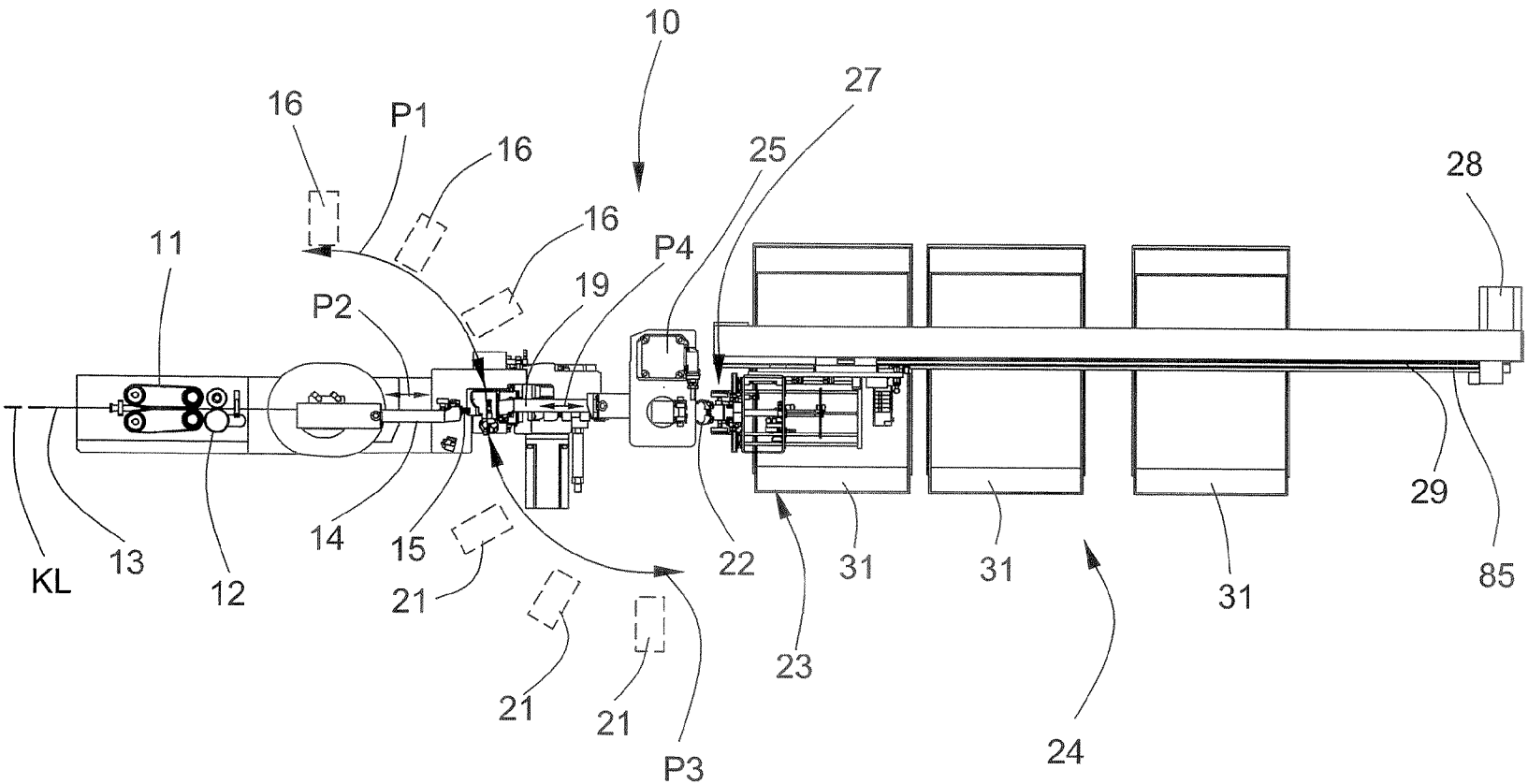
FIG. 2 is a plan view of a wire processing machine according to the present invention.
Figure 3:
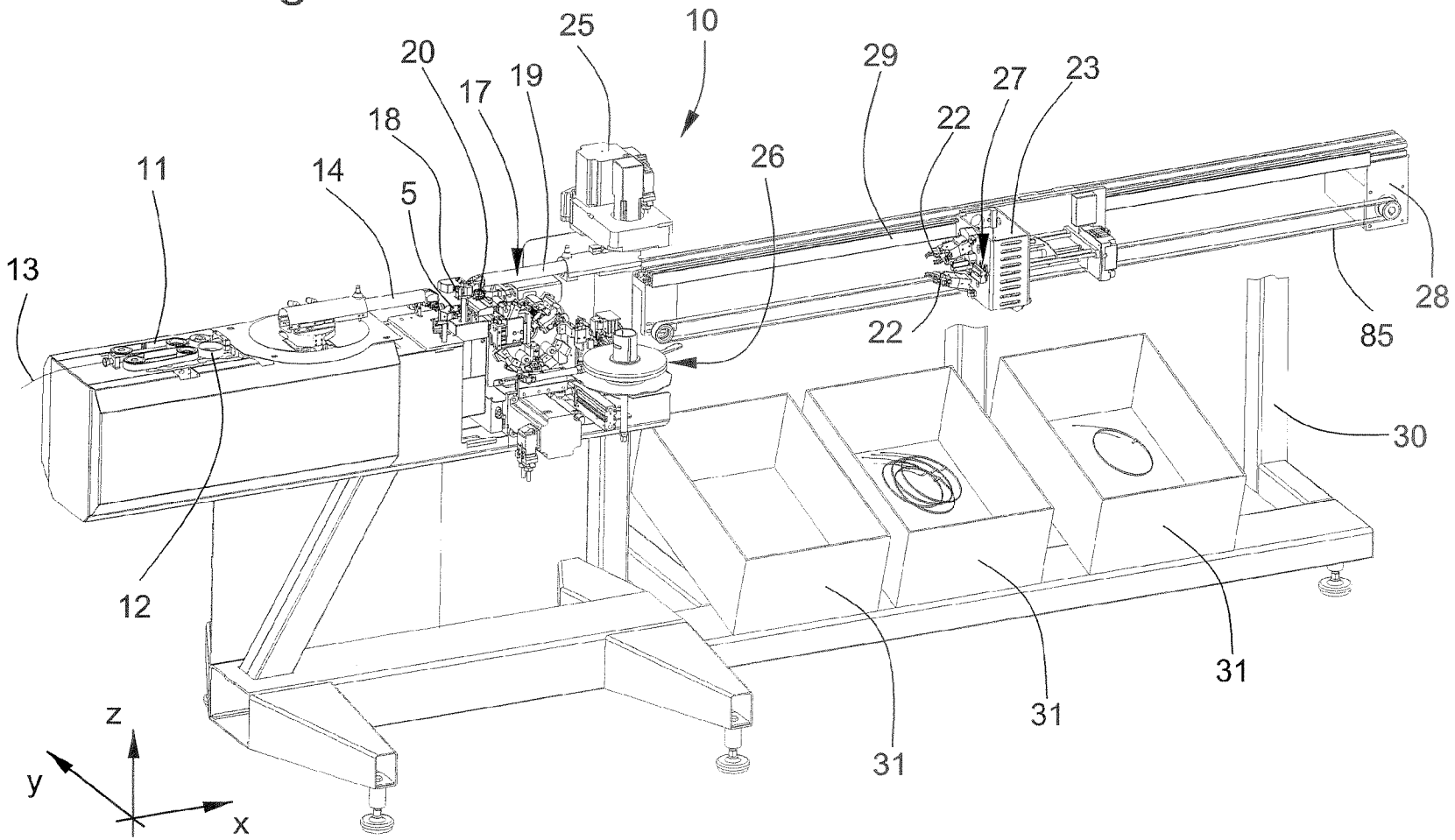
FIG. 3 is a perspective view of the wire-processing machine shown in FIG. 2.

FIG. 2 shows a plan view of a wire processing machine 10 and FIG. 3 a perspective view of the wire processing machine 10.

Provided at the entry to the wire processing machine 10 is a wire advancing device comprising a belt drive 11 and a length-measuring device 12. The belt drive 11 feeds a wire 13 to a first swivel arm 14 with a first gripper 15. The belt drive 11 advances the wire 13 and the length-measuring device 12 measures the advanced wire length, the advanced wire length corresponding to the cut length of wire that is to be manufactured and whose ends are to be processed. Not illustrated is the wire stock, for example a wire drum or a wire reel.

By means of drives, the first swivel arm 14 can be set into a swiveling movement symbolized with an arrow P1 and/or into a linear movement that is symbolized with an arrow P2. By means of turning movement P1 and linear movement P2, the first swivel-arm 14 as feeding device serves leading wire-ends 5 to processing stations 16 (for example crimp presses and/or seal-loaders) arranged to the side of the longitudinal axis of the wire KL.

After the leading wire-end 5 has been processed, by means of grippers 15 the first swivel arm 14 brings the leading wire-end 5 back into the longitudinal axis of the wire KL. The wire 13 is than advanced by means of the belt drive 11 until a coiler 17 can grip the leading wire-end 5. The belt drive 11 then advances the defined cut length of wire 1 that is measured by means of the length measuring device 12, and the coiler 17 that is synchronized with the belt drive 11 simultaneously coils the advanced cut-off length of wire into a coil 2 according to FIG. 1. After the coil 2 has been manufactured, the cut length of wire 1 is cut off from the wire 13 by means of a cutting-off/insulation stripping unit and/or stripped of insulation with cutting-off/insulation-stripping blades 18. The leading wire-end of the next cut length of wire is gripped by the first swivel arm 14 by means of grippers 15 and fed to the processing stations 16 for processing.

The trailing wire-end 7 of the coiled cut length of wire 1 is grasped by a second swivel arm 19 and set in a swiveling motion symbolized with an arrow P3 and/or in a linear motion symbolized with an arrow P4, the trailing wire-end 7 being fed to processing stations 21 (for example, crimp presses and/or seal loaders) that are arranged at the side of the longitudinal axis of the wire KL.

Before the trailing wire-end 7 is processed, the coil 2 is accepted by coil grippers 22 of a stacker unit 23. The stacker unit 23 then moves in the wire-advancing direction towards a deposit 24 until the stacker unit 23 reaches a position approximately below the swivel arm drive 25 of the second swivel arm 19.

Before processing of the trailing wire-end 7 takes place, a tape station 26 makes a cut length of tape ready for manufacturing the bind 4. The cut length of tape is accepted by a binding device 27 of the stacker unit 23.

After processing of the trailing wire-end 7 has taken place, by means of grippers 20 the second swivel arm 19 brings the trailing wire-end 7 back into approximately the longitudinal axis of the wire KL, and the stacker unit 23 is moved with the coil 2 further in the direction of the deposit 24. During the travel of the stacker unit 23 to the deposit 24, the bind 4 is manufactured by means of the binding device 27. The coil 2 with bind 4 is sorted according to good/bad criteria into one or other of the containers 31 of the deposit 24. A belt drive 28 moves the stacker device 23 by means of the belt 85 along a linear guide 29 that is arranged on a machine rack 30. Entered in FIG. 3 are the direction arrows x, y, and z. By means of the belt drive 11, the wire 13 is advanced in the x direction, i.e. the longitudinal axis of the wire KL lies in the x direction. The stacker unit 23 moves in the x direction and lays the completed coil 2 in the z direction in the corresponding container 31. For the purpose of pushing off the coil 2, the coiler 17 is movable in the y direction as shown in FIG. 6.

Figure 4:
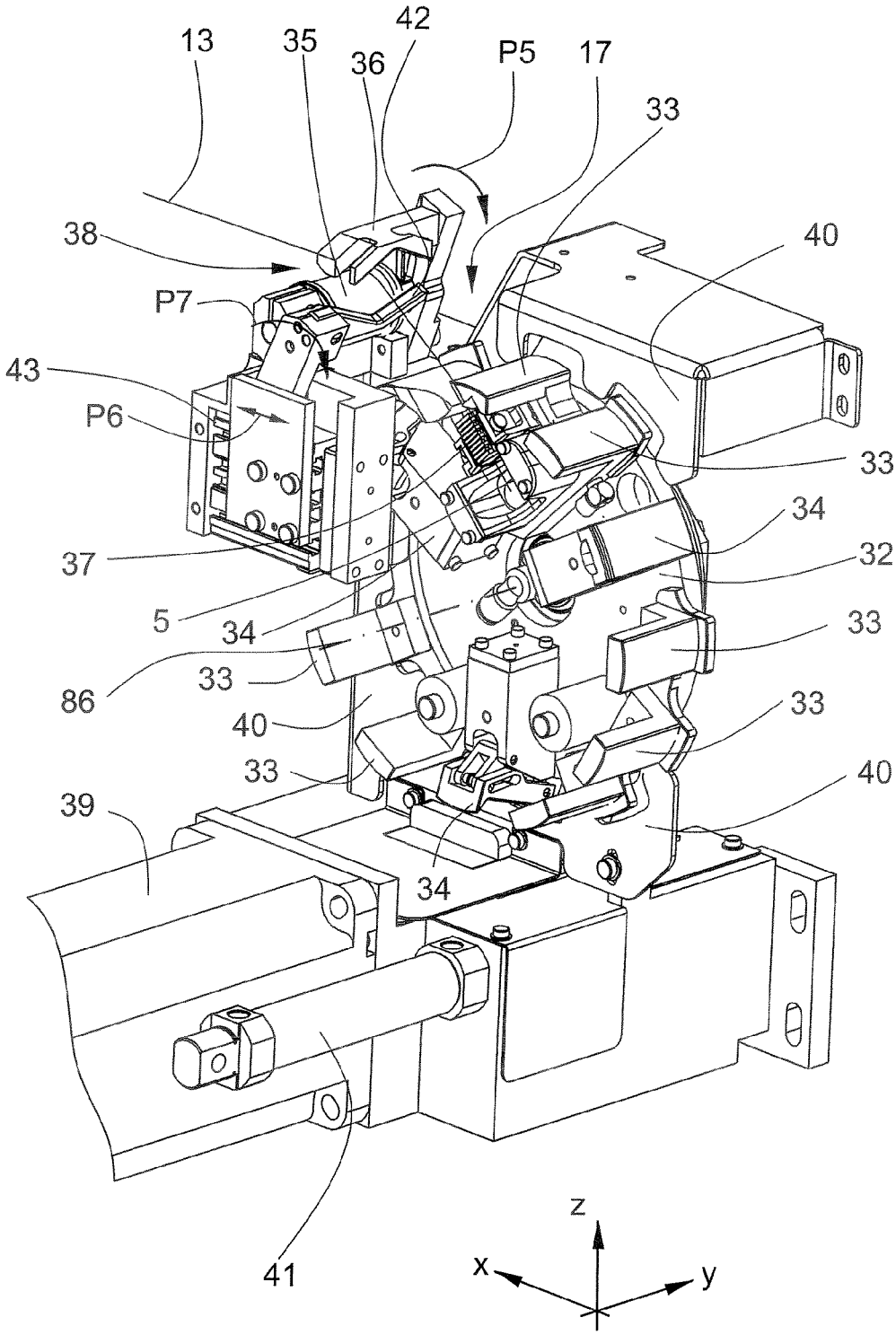
FIG. 4 is a perspective view of a oiler that forms the cut length of wire into a coil.

FIG. 4 shows the coiler 17 that forms the cut length of wire 1 into a coil 2. Arranged in a circle peripherally on a rotatable coiling disk 32 are supporting fingers 33 and tension fingers 34. Supporting fingers 33 and tension fingers 34 bear the windings 3 of the coil 2. FIG. 7 shows details of the fingers 33, 34. The coiling disk 32 lies in the plane that is defined by the axes x and z and rotates about a horizontal axis of rotation 86 that runs parallel to the y axis. After processing of the leading wire-end 5 has taken place, the belt drive 11 advances the wire 13 further. As soon as the leading wire-end 5 passes a first roller 35 of a wire guide 38, the roller 35 and a counterfinger 42 are set in a linear motion P6 and the counterfinger 42 additionally in a rotating motion P7 by means of a drive unit 43. Simultaneously, the roller 35 sets a guide finger 36 in a rotating movement P5 about a fixed axis 48, whereby the guide finger 36 moves to the counterfinger 42 and deflects the wire 13 on advancing in the direction of an opened coil gripper 37. Guide finger 36 and counterfinger 42 also serve as guiding aids for lateral guidance of the wire 13. The coil gripper 37 is arranged on the coiling disk 32 within the circle that is formed by the fingers 33, 34. Roller 35, guide finger 36, counterfinger 42, and the drive unit 43 that imparts the linear movement P6 form the fixed wire guide 38 relative to the coiling disk 32. The length measuring device 12 measures the advanced length of wire, and the control stops the belt drive 11 as soon as the length of wire needed to reach as far as the coil gripper 37 is attained. The coil gripper 37 that grasps the wire-end is then closed. A coiler drive 39 drives the coiling disk 32, whereby the coiler drive 39 and the belt drive 11 are synchronized when manufacturing the coil 2, the amount of wire that is advanced by the belt drive 11 is simultaneously coiled by the coiler disk 32, whereby the windings 3 of the arising coil 2 rest on the fingers 33, 34. After the coiling operation, the coil 2 is grasped by the coil grippers 22 of the stacker unit 23, and the coiling disk 32 is moved in the y direction by means of a cylinder 41, whereby a remover 40 that is arranged locationally fixed relative to the coiling disk 32 between the fingers 33, 34 pushes the coil 2 off the fingers 33, 34. This is shown in detail in FIG. 6 and FIG. 7.

Figure 5:
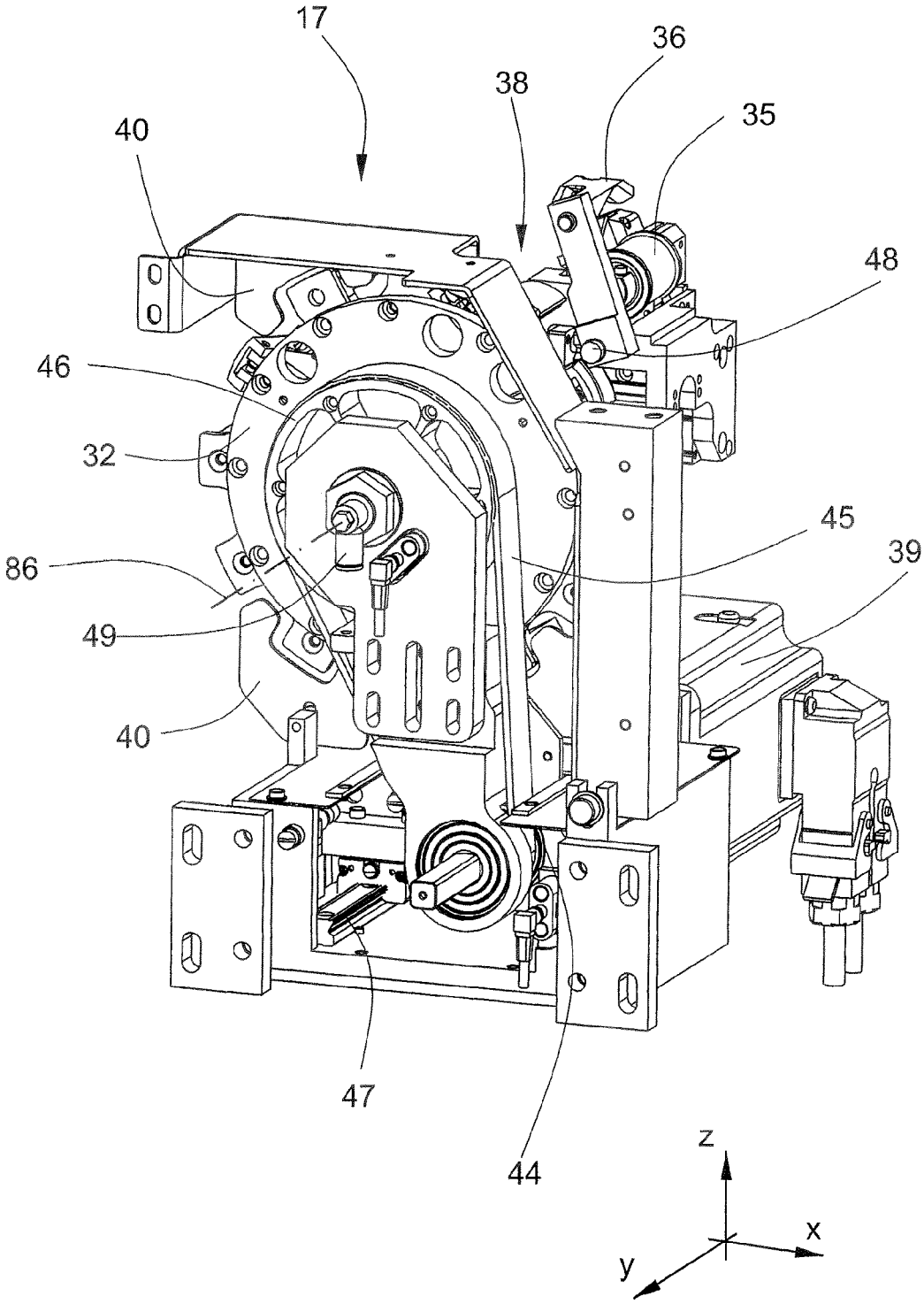
FIG. 5 is a perspective view of the coiler shown in FIG. 4 viewed from the back.
Figure 6:
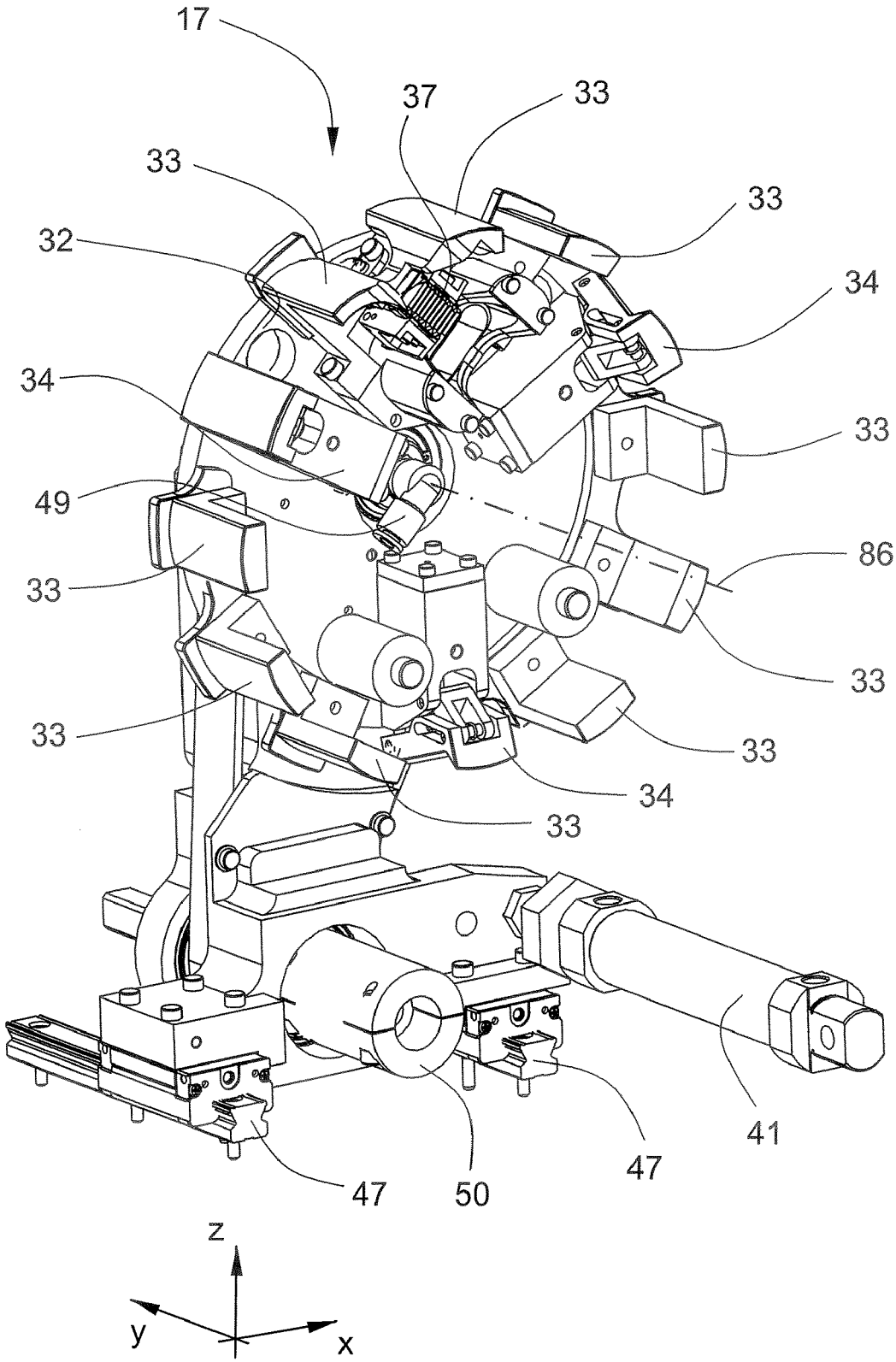
FIG. 6 is a perspective view of linear guides of a coiling disk.
Figure 7:
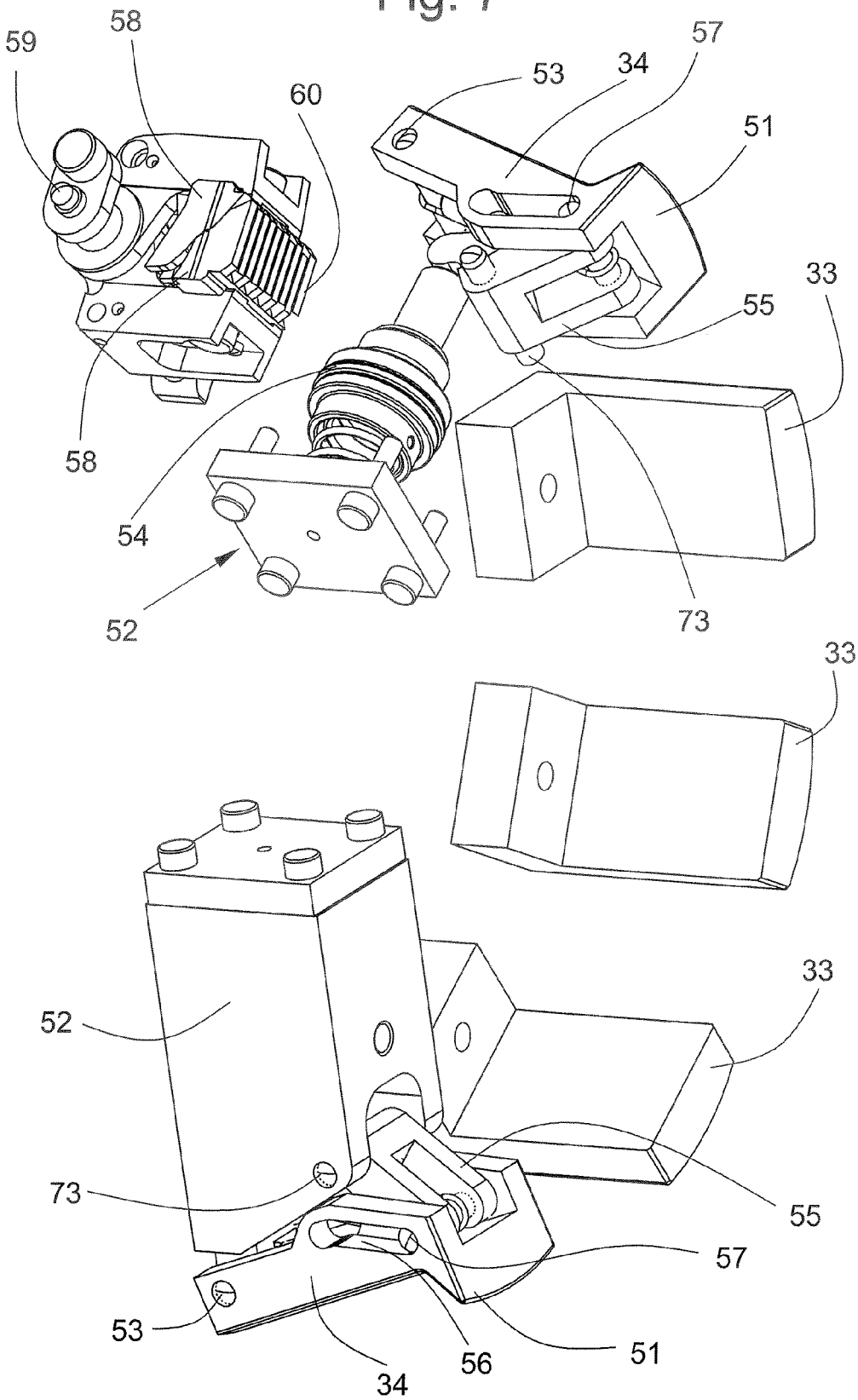
FIG. 7 is an exploded perspective view of the details of the coiler shown in FIG. 4.

FIG. 5 shows the rear side of the coiler 17 and FIG. 6 the front side of the coiling disk 32 with linear guides 47. A motor pulley of the coiler drive 39 drives a toothed belt 45 that drives a coiler pulley 46 and thereby the coiling disk 32. By means of the cylinder 41, the coiling disk 32 along with the coiler drive 39 can be moved along linear guides 47 in the y direction for the purpose of sliding the coil 2 off the fingers 33, 34, the coil 2 striking against the remover 40 and being thus pushed over the fingers 33, 34. Referenced with 49 is an air connection, via which compressed air can be fed to pneumatic units (coiler gripper 37, tension finger 34) of the coiling disk 32. The motor pulley 44 is connected to the coiler drive 39 by means of a coupling 50.

FIG. 7 shows details of the coiler 17, in particular the pneumatic units such as coil gripper 37 and tension finger 34 that are arranged on the coiling disk 32. The supporting fingers 33 bear the windings 3 of the coil 2. The tension fingers 34 bear and hold the windings 3 of the coil 2. Each tension finger 34 has at its free end a nose 51 that restrains the coil 2 during the coiling operation. Moreover, the tension finger 34 is rotatable about an axis 53 by means of a pneumatic drive 52. In the position shown, the coil 2 can be slid off the fingers 33, 34 by means of the remover 40. By means of the cylinder 54, the pneumatic drive 52 actuates a lever that is rotatable about an axis 73 and which by means of pins 57 that engage in elongated holes 56 rotates the tension finger 34 about the axis 53 until the tension finger 34 is in the same position as the supporting finger 33. In this position, the coiling disk 32 is ready for the coiling operation.

FIG. 7 shows the coil gripper 37 for holding the leading wire-end 5. The two gripper halves 58, which are shown in closed position, are pneumatically rotatable and open able about an axis 59 and by means of fingers 60 grasp the wire-end.

Figure 8:
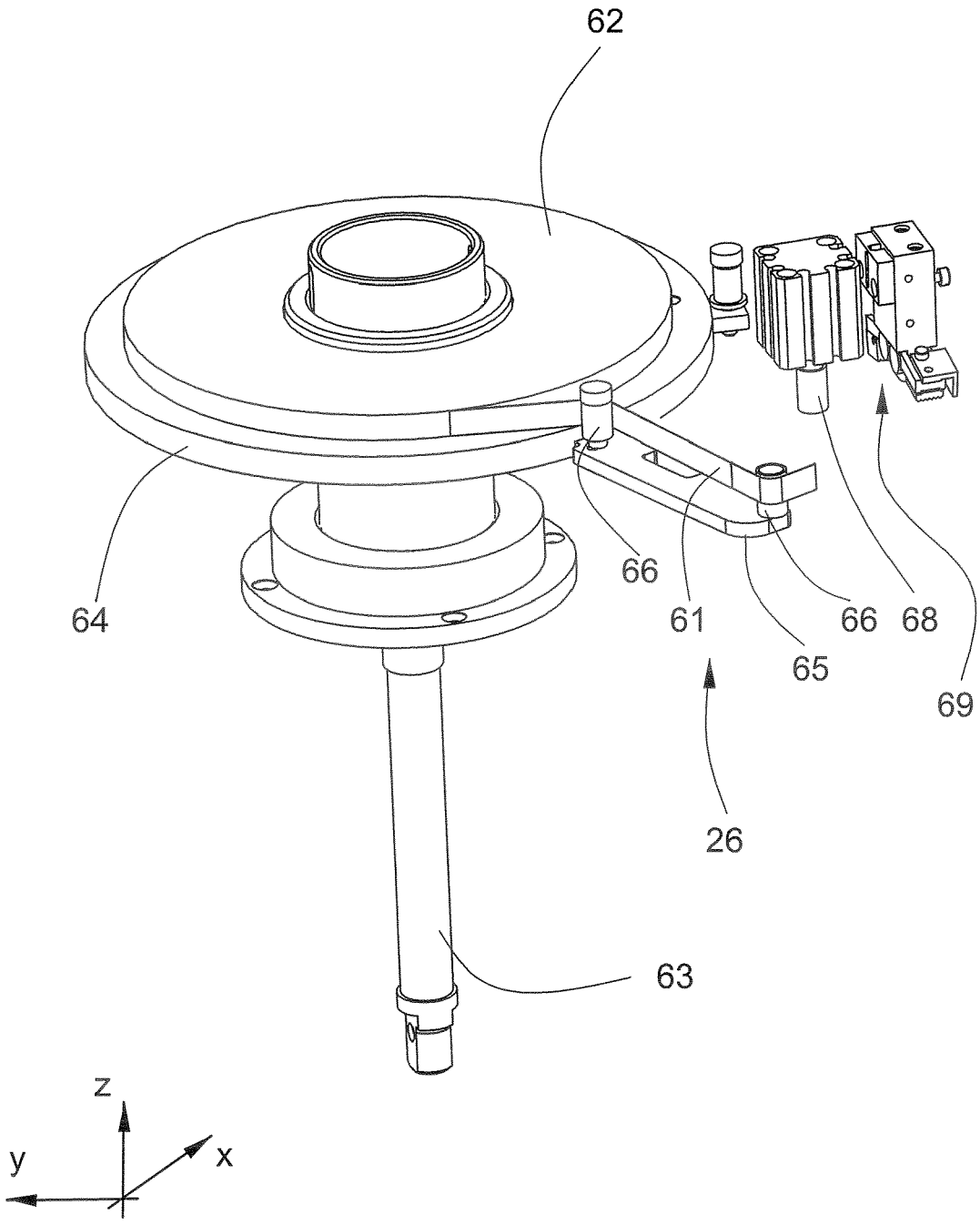
FIGS. 8 to 10 are perspective views of a tape station for preparing an adhesive tape.
Figure 9:
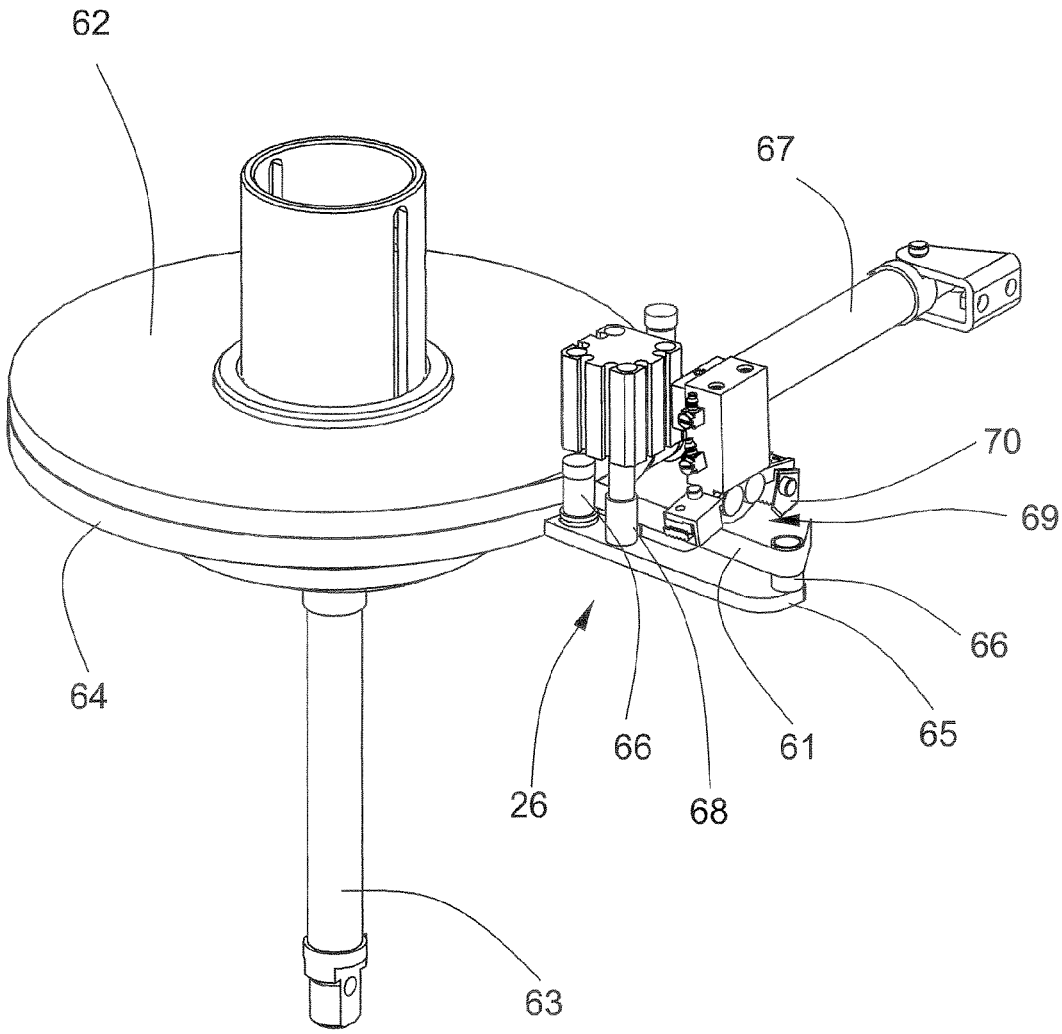
Figure 10:
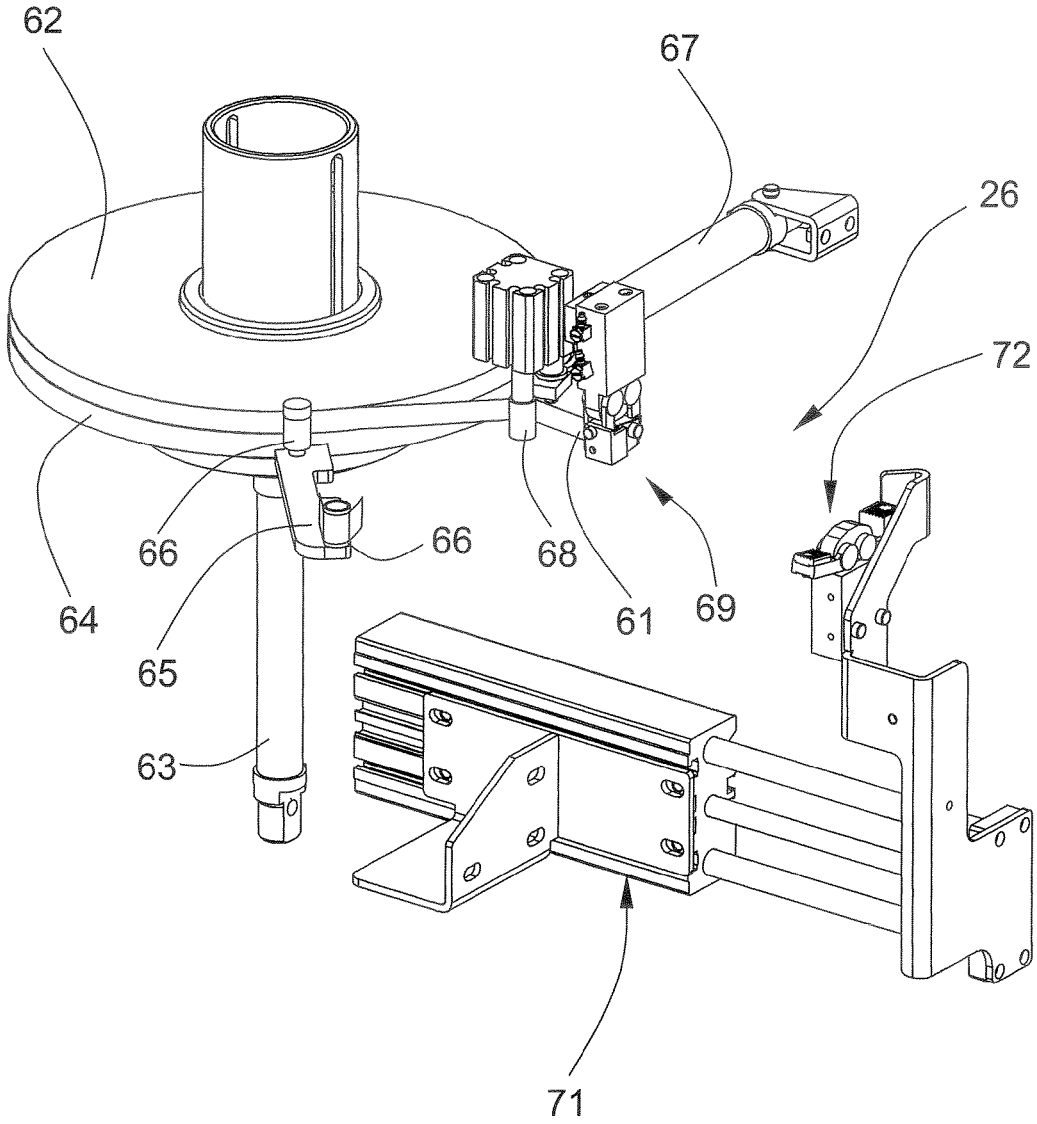

FIGS. 8 to 10 show a tape station 26 on which an adhesive tape 61 with a layer of adhesive applied to one side is being prepared for a length that is necessary for the bind 4. A stock of tape 62 rests on a tape disk 64 which, by means of a cylinder 63, is height-adjustable in the z direction, which to improve accessibility for the first, manual threading of the adhesive tape 61 is in the upper position. Arranged on the tape disk 64 is a finger 65 with two finger pins 66. The non-adhesive or dry side of the adhesive tape 61 is pulled manually over the finger pin 66 that is close to the disk, and the starting end of the tape firmly bonded onto the side with the adhesive layer on the finger pin 66 that is distant from the disk. The manual threading is thus complete, and the tape disk 64 is lowered and, by means of the cylinder 67, swiveled until the adhesive tape 61 as shown in FIG. 9 is in line with an extendable diversion pin 68 and a tape gripper 69 with cutting blade 70. The tape gripper 69 is then closed and the adhesive tape 61 cut through by means of the cutting blade 70. As shown in FIG. 10, the tape disk 64 is swiveled back into the starting position. The remnant of tape that adheres to the finger pin 66 distant from the disk is removed manually. A tape pull-off gripper 72 that is linearly actuatable in the y direction by means of a pneumatic linear unit 71 is then moved in the open state between the diversion pin 68 and the tape gripper 69. The tape pull-off gripper 72 is then closed, and the tape gripper 69 opened. The linear unit 71 now moves the tape pull-off gripper 72 back, together with which the adhesive tape 61 is pulled out of the tape stock 62 by the length that is necessary for manufacturing the bind 4.

Instead of the adhesive tape 61, a tape with comparable properties can be used. Also suitable, for example, is a plastic tape that has on one side hemispherical heads on short stems arranged in wavelike pattern which, when pressed together, allow formation of a permanent or releasable fastening.

Figure 11:
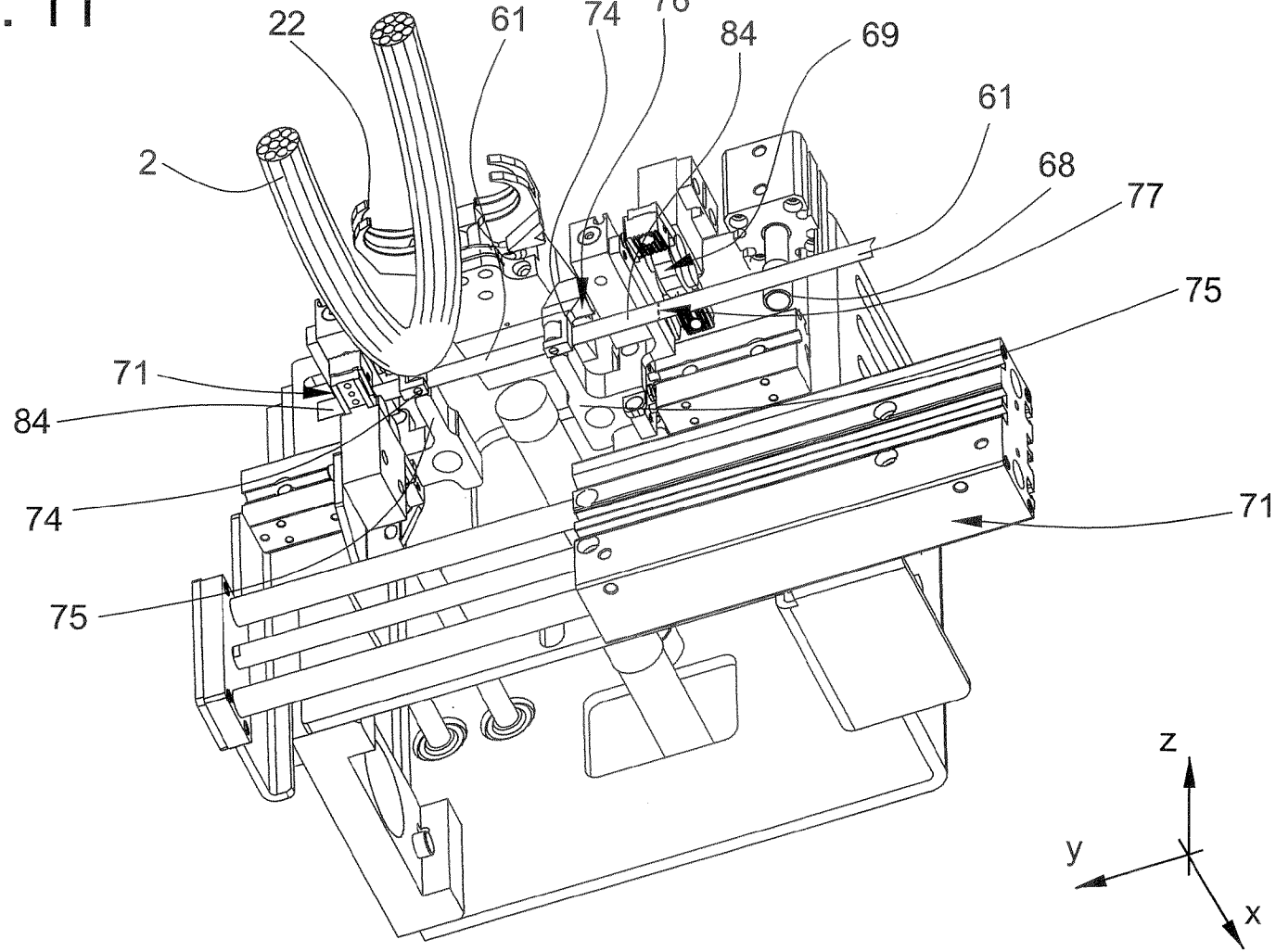
FIGS. 11 and 12 are perspective views of a stacker unit during reception of the adhesive tape.
Figure 12:
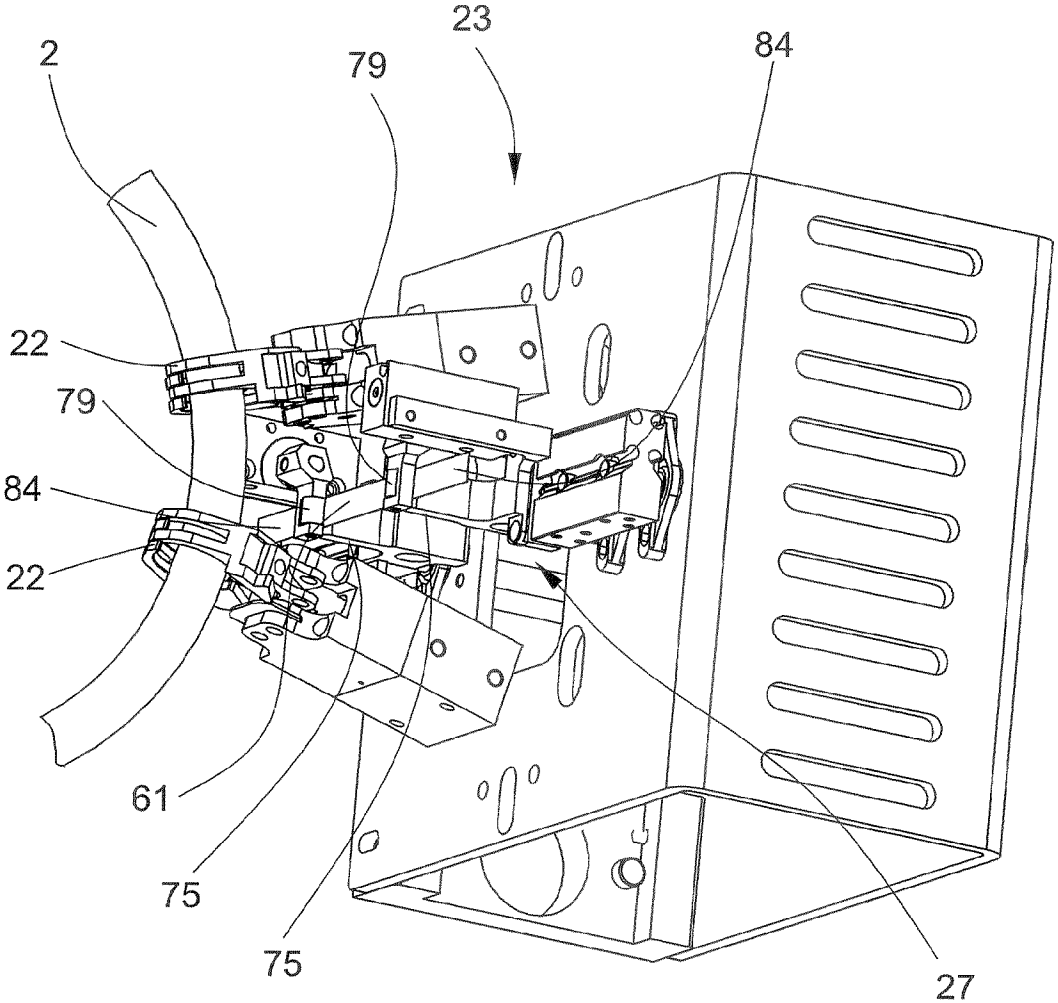

FIG. 11 and FIG. 12 show the stacker unit 23 when receiving the prepared adhesive tape 61 from the tape station 26. FIG. 11 shows the stacker unit 23 together with parts of the tape station 26 from below, wherein for greater clarity only the upper coil gripper 22 is made visible, the lower coil gripper is not shown in FIG. 11. The coil grippers 22 are not yet closed, in FIG. 11 the coil 2 is still held firmly by the fingers 33, 34 of the coiling disk 32. The adhesive tape 61 that is pulled out of the tape stock 62 by the tape pull-off gripper 72 is held firmly by roller grippers 76 that each consist of a rotatable roller arm 74 and a locationally fixed pressure arm 75, the tape pull-off gripper 72 having already been opened. The roller grippers 76 are part of the binding device 27. On closing the tape gripper 69, the adhesive tape 61 that runs in the y direction is cut through at the point marked with dots 77 by means of the cutting blade 70. The wire-stock end of the adhesive tape 61 is held firmly by the tape gripper 69. As shown in FIG. 12, the stacker unit 23 and the binding device 27 are ready for the movement in the x direction to the deposit 24 and on their way to the deposit 24 for the bind 4 to be manufactured. The coil 2 has been accepted from the coiler 17 by the coil gripper 22 and is held firmly by the latter. The cut length of adhesive tape 61 is held firmly by means of the roller gripper 76 and is ready for the binding operation.

Figure 13:
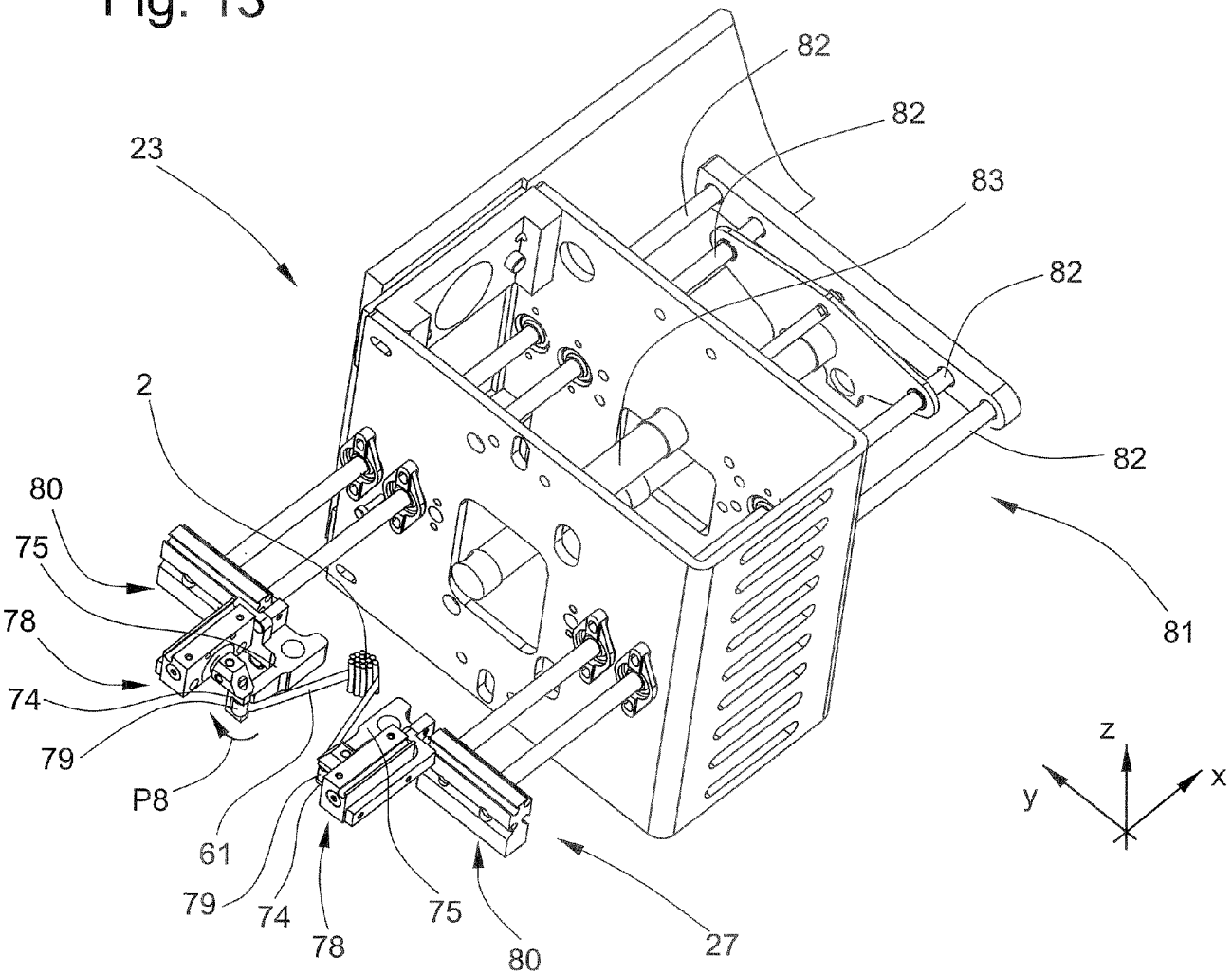
FIGS. 13 and 14 are perspective views of a binding device during the binding operation.
Figure 14:
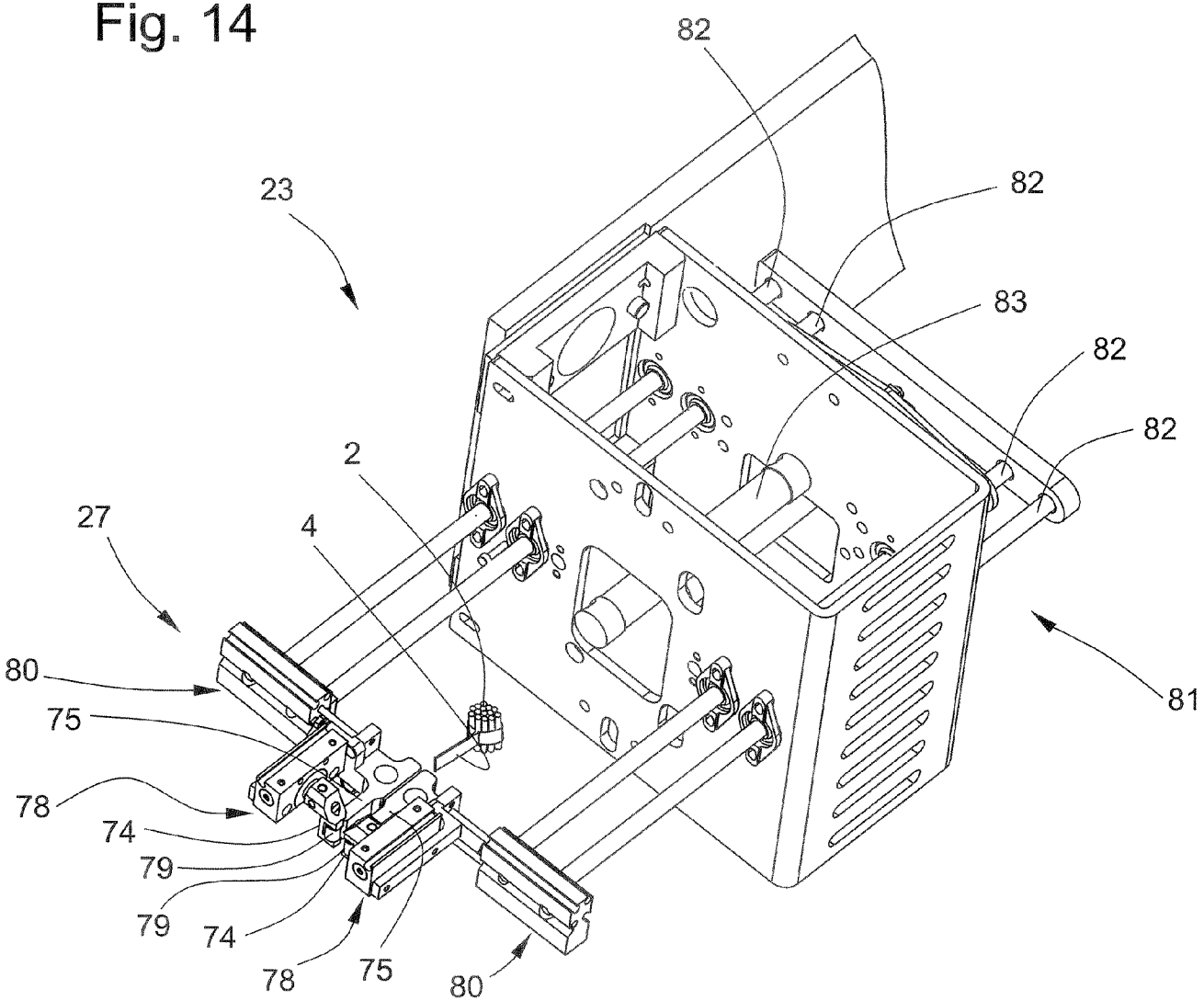

FIG. 13 and FIG. 14 show the binding device 27 during the binding operation. For greater clarity, the coil grippers 22 are not visibly shown. The roller arm 74 of the roller gripper 76 can execute the rotating movement P8 and is rotatable by means of a pneumatic rotator unit 78. A roller 79 of the roller arm 74 presses the adhesive tape 61 against the pressure arm 75, whereby the non-adhesive side of the adhesive tape 61 rests on the pressure arm 75 and the adhesive layer of the adhesive tape 61 rests on the roller 79. Roller gripper 76 and rotator unit 78 are movable in the y direction by means of a pneumatic linear unit 80, whereby the two roller grippers 76 are movable towards or away from each other. The two pneumatic linear units 80 are also movable in the x direction by means of a pneumatic linear unit 81 comprising push-rods 82 and cylinder 83. As shown in FIG. 13, the roller grippers 76 are movable in the x direction against the wire advance direction to the coiler 17, whereby the adhesive layer of the adhesive tape 61 comes to rest on the coil 2. Through the relative movement of the roller grippers relative to the coil 2, the free ends 84 of the adhesive tape 61 that are shown in FIG. 11 are pulled over the rollers 79 without leaving them. In the end position of the roller grippers 76 that is shown in FIG. 13, the adhesive tape 61 is ready for manufacturing of the bind 4. To manufacture the bind 4, the two roller grippers 76 are moved in the y direction towards each other, whereby the pressure arms 75 lay the adhesive tape 61 around the coil 2, and the two remaining tape ends press against each other adhesive layer to adhesive layer, the ends 84 thereby leaving the rollers 79. Subsequently, the linear unit 81 pushes the linear unit 80, and with it the roller gripper 76, into the end position in the x direction shown in FIG. 14. The coil 2 with the bind 4 is now ready for handover to the deposit 24 in one of the containers 31. Handover is effected by opening the coil grippers 22.

In accordance with the provisions of the patent statutes the present invention has been described in what is considered to represent its preferred embodiment. However, it should be noted that the invention can be practiced otherwise than as specifically illustrated and described without departing from its spirit or scope.

What is claimed is:

1. A coiler for manufacturing a coil with at least one winding, wherein a coiling gripper that is arranged on a rotatable coiling disk firmly holds the leading wire-end of a cut-off length of wire, and fingers that are arranged peripherally on the coiling disk form the cut-off length of wire into a coil, comprising:

a coiling disk rotatable about a horizontal axis of rotation;

a coil gripper arranged on said coiling disk within a plurality of fingers on said coiling disk; and a wire guide including means for deflecting from a direction of advancement a leading wire-end to said coil gripper to form the coil.

2. The coiler according to claim 1 wherein for removing the coil from said fingers, said coiling disk is movable in a direction of the horizontal axis of rotation, whereby the coil strikes against a stationary remover and can thus be pushed over the fingers.

3. The coiler according to claim 1 wherein said coiling disk along with a coiling drive is movable along linear guides in a direction of the horizontal axis of rotation.

4. The coiler according to claim 3 wherein said coiling disk is drivable by a motor pulley, a belt, and a coiler pulley in cooperation.

5. The coiler according to claim 3 wherein said coiling disk is drivable along said linear guides by a cylinder.

6. The coiler according to claim 1 wherein said fingers include supporting fingers and tension fingers that bear windings of the coil and are arranged in a circle on a periphery of said coiling disk.

7. The coiler according to claim 6 including provided on a free end of each said tension finger is a nose that during a coiling operation restrains the coil, and each said tension finger can be swiveled about an axis in the direction of the horizontal axis of rotation whereby said nose releases the coil for removal.

8. The coiler according to claim 1 wherein said wire guide has a roller, a guide finger, and a counterfinger, wherein said roller and said counterfinger can be set in a linear movement, and said counterfinger additionally set in a rotating movement, and said guide finger can be set in a rotating movement by said roller, the leading wire-end being divertable by said wire guide when advanced in a direction of said coil gripper.

9. A method for manufacturing a coil with at least one winding, wherein a leading wire-end of a cut length of wire is firmly held by a coil gripper that is arranged on a rotatable coiling disk, and wherein the cut length of wire is formed into a coil by fingers that are arranged peripherally on the coiling disk, comprising the steps of:

rotating the coiling disk about a horizontal axis of rotation;

firmly holding the leading wire-end within the fingers with the coil gripper on the coiling disk; and feeding the leading wire-end to the coil gripper with a wire guide including means for deflecting from a direction of advancement the leading wire-end to said coil gripper to form the coil.

10. The method according to claim 9 including bearing the coil by supporting fingers and tension fingers arranged in a circle on a periphery of the coiler disk.

11. The method according to claim 9 wherein for the purpose of removing the coil from the fingers, moving the coiling disk in the direction of the horizontal axis of rotation, whereby the coil strikes against a stationary remover and is thus pushed over the fingers.

12. A coiler for manufacturing a coil with at least one winding, wherein a coiling gripper that is arranged on a rotatable coiling disk firmly holds the leading wire-end of a cut-off length of wire, and fingers that are arranged peripherally on the coiling disk form the cut-off length of wire into a coil, comprising:

a coiling disk rotatable about a horizontal axis of rotation;

a coil gripper arranged on said coiling disk within a plurality of fingers on said coiling disk;

a wire guide for feeding a leading wire-end to said coil gripper to form the coil; and wherein said wire guide has a roller, a guide finger, and a counterfinger, wherein said roller and said counterfinger can be set in a linear movement, and said counterfinger additionally set in a rotating movement, and said guide finger can be set in a rotating movement by said roller, the leading wire-end being divertable by said wire guide when advanced in a direction of said coil gripper.

* * * * *